US007139655B2

(12) United States Patent
Nakazawa et al.

(10) Patent No.: US 7,139,655 B2
(45) Date of Patent: Nov. 21, 2006

(54) INTAKE AIR PARAMETER ESTIMATING DEVICE FOR INTERNAL COMBUSTION ENGINE

(75) Inventors: Takashi Nakazawa, Kawasaki (JP); Takeshi Suzuki, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 114 days.

(21) Appl. No.: 11/066,553

(22) Filed: Feb. 28, 2005

(65) Prior Publication Data

US 2005/0234630 A1 Oct. 20, 2005

(30) Foreign Application Priority Data

Apr. 20, 2004 (JP) ..... 2004-124022
Apr. 20, 2004 (JP) ..... 2004-124023

(51) Int. Cl.
*F02D 45/00* (2006.01)

(52) U.S. Cl. ..... 701/102; 73/115

(58) Field of Classification Search ..... None
See application file for complete search history.

(56) References Cited

FOREIGN PATENT DOCUMENTS

JP 10-153465 A 6/1998

*Primary Examiner*—Andrew M. Dolinar
(74) *Attorney, Agent, or Firm*—Global IP Counselors, LLP

(57) ABSTRACT

An intake parameter estimating device is provided for estimating a tuning frequency of an internal combustion engine, which in turn can be used to estimate an intake air pressure of the internal combustion engine. The intake parameter estimating device basically has a fundamental frequency calculating section, an engine rotational speed detecting section and a tuning frequency calculating section. The fundamental frequency calculating section calculates a fundamental frequency of a pressure wave inside an air intake pipe based on a shape of the air intake pipe and speed of sound. The engine rotational speed detecting section detects an engine rotational speed. The tuning frequency calculating section calculates a tuning frequency of the pressure wave inside the air intake pipe based on the fundamental frequency and the engine rotational speed. The tuning frequency can then be used to estimate the intake air pressure of the internal combustion engine.

20 Claims, 7 Drawing Sheets

INTAKE AIR PARAMETER ESTIMATING DEVICE FOR INTERNAL COMBUSTION ENGINE

CROSS-REFERENCE TO RELATED APPLICATIONS

This application claims priority to Japanese Patent Application Nos. 2004-124022 and 2004-124023. The entire disclosures of Japanese Patent Application Nos. 2004-124022 and 2004-124023 are hereby incorporated herein by reference.

BACKGROUND OF THE INVENTION

1. Field of the Invention

The present invention relates to an intake air parameter estimating device especially used for estimating a tuning frequency estimating device for an internal combustion engine. More particularly, the present invention relates to a technology for improving the accuracy with which the intake air pressure in the vicinity of an intake valve of an internal combustion engine is estimated.

2. Background Information

The gas inside a cylinder of an internal combustion engine is composed of the residual gas from the previous cycle and the fresh air that is newly inducted into the cylinder. Therefore, in order to know the composition of the gas inside the cylinder, it is necessary to estimate the quantity of the residual gas. The residual gas includes gas remaining in the gap volume of the cylinder and exhaust gas that blows between the exhaust port side and the intake port side during the overlap period when both the intake valve and the exhaust valve are open (hereinafter referred as "blow-by gas"). Therefore, it is necessary to find the quantity of the blow-by gas with good accuracy in order to obtain an accurate estimate of the quantity of the residual gas. The blow-by gas quantity depends on the pressure difference between the exhaust port and the intake port. Therefore, it is necessary to obtain an accurate estimate of the intake air pressure in the vicinity of the intake valve during the overlap period.

Japanese Laid-Open Patent Publication No. 10-153465 discloses a technology for estimating the state of the intake air pressure in view of the backflow caused by blow-by gas. The technology disclosed in the above mentioned publication serves to correct the error in an intake air pressure value detected by an air flow meter resulting from backflow. In order to compensate for the amount of error resulting from the backflow, the intake air temperature is detected and the engine tuning rotational speed is corrected based on the detected intake air temperature. Then the corrected engine tuning rotational speed is used to calculate an correction amount of the air flow rate for correcting the error caused by the effect of intake air pressure pulsation.

More specifically, the above mentioned reference describes a technology whereby the engine rotational speed that resonates with the intake air pressure pulsation ("resonance rotational speed") is corrected based on the intake air temperature and the amount by which the resonance rotational speed is corrected is used in a correction of the error of the intake air flow rate detected by an air flow meter. In this reference, an intake air flow rate error correction quantity is found based on the throttle opening degree and an engine rotational speed that has been corrected based on a ratio of the intake air temperature and a reference temperature corresponding to a reference state.

In view of the above, it will be apparent to those skilled in the art from this disclosure that there exists a need for an improved intake air pressure estimating device and tuning frequency estimating device. This invention addresses this need in the art as well as other needs, which will become apparent to those skilled in the art from this disclosure.

SUMMARY OF THE INVENTION

In the conventional technology described in the above mentioned reference, since the change in the tuning rotational speed of the engine is treated as a change resulting from a change in the intake air temperature alone, the tuning rotational speed of the engine cannot be estimated very accurately. Thus, the tuning frequency of the intake air pressure that tunes to the engine rotational speed cannot be estimated very accurately. After the intake valve closes, pressure vibrations (pressure wave) that gradually attenuate remain inside the intake air pipe. If a positive pressure portion of this pressure wave is tuned to or synchronized with the intake stroke of the next cycle, then the pressure at the intake timing will increase. Conversely, if a negative pressure portion of this pressure wave is tuned to the intake stroke of the next cycle, then the pressure at the intake timing will decrease. A known method of expressing the overlapping state of the pressure waves is called the "tuning order" and is related to the frequency of the pressure wave and the number of intake operations per second. More specifically the tuning order equals the frequency of the pressure wave divided by the number of intake operations per second. In other words, the frequency of the intake air pressure is affected by the engine rotational speed as well as the intake air temperature. Thus, with the conventional technology described in the above mentioned reference, the tuning frequency of the intake air pressure wave that tunes to the engine rotational speed cannot be estimated accurately because only the intake air temperature is taken into account. Consequently, the intake air pressure in the vicinity of the intake valve cannot be estimated very accurately.

Moreover, When the throttle opening is used as a parameter representing the amplitude of the intake air pressure pulsation, as is done in the conventional technology described in the above mentioned reference, situations in which the amplitude of the intake air pulsation changes due to a change in the internal EGR ratio are not accommodated. Although it is possible to include a correction for changes in the internal EGR ratio in the conventional technology, such a correction requires complex computations.

The present invention was conceived in view of these issues regarding the existing technology, and one object of the present invention is to improve the accuracy with which the intake air pressure in the vicinity of the intake valve is estimated by increasing the accuracy with which the tuning frequency of the intake air pressure wave is estimated.

Another object of the present invention is to improve the accuracy with which the intake air pressure in the vicinity of the intake valve is estimated by appropriately selecting parameters to represent the amplitude of the intake air pulsation.

In order to achieve the above mentioned objects and other objects of the present invention, an intake air parameter estimating device for an internal combustion engine is provided that basically comprises a fundamental frequency calculating section, an engine rotational speed detecting section and a tuning frequency calculating section. The fundamental frequency calculating section is configured to calculate a fundamental frequency of a pressure wave inside an air intake pipe based on a shape of the air intake pipe and speed of sound. The engine rotational speed detecting section is configured to detect an engine rotational speed. The tuning frequency calculating section is configured to calculate a tuning frequency of the pressure wave inside the air intake pipe based on the fundamental frequency and the engine rotational speed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE FIRST EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
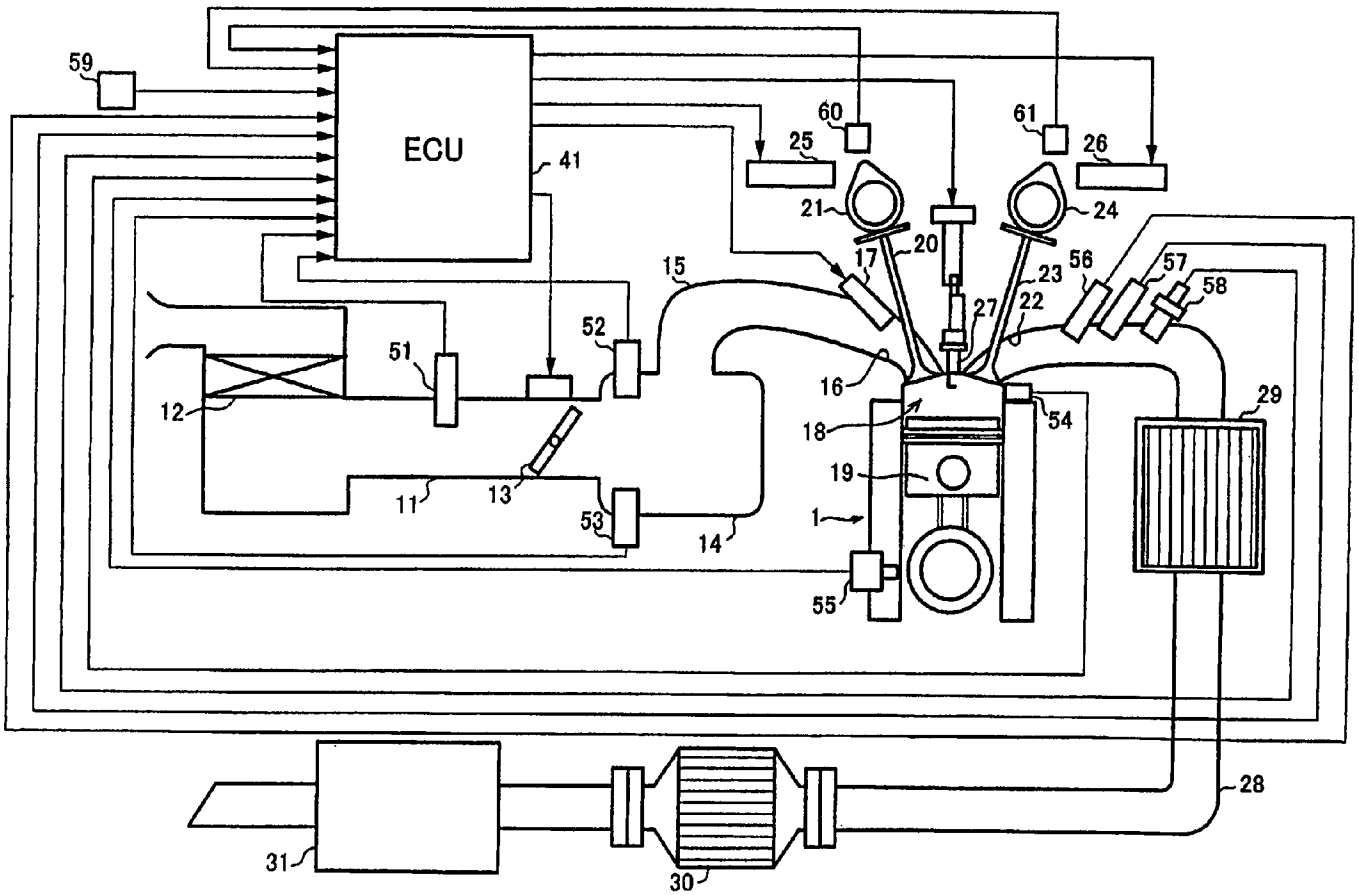
FIG. 1 is a simplified overall schematic view of an internal combustion engine provided with an intake air pressure or parameter estimating device in accordance with a first embodiment of the present invention.

Referring initially to FIG. 1, the main features of an internal combustion engine 1 is illustrated with an intake air pressure (parameter) estimating device is in accordance with a preferred embodiment of the present invention. As seen in FIG. 1, the engine 1 has an air intake passage 11 with an air cleaner 12 mounted at a position near the entrance of in the air intake passage 11. The air cleaner 12 is configured and arranged to remove dust and other fine particles from the intake air. An electronically controlled throttle valve 13 is installed inside the air intake passage 11 at a position downstream of the air cleaner 12. A surge tank 14 is installed downstream of the throttle valve 13 with a plurality of runners 15 (intake air pipe) being attached to the surge tank 14 to form an intake manifold. The intake air inside the surge tank 14 flows through the runners 15 and into intake ports 16 formed in a cylinder head to enter a plurality of cylinders (only one shown). A fuel injector 17 is installed in each of the intake ports 16 for injecting atomized fuel into the intake air that is being supplied to a combustion chamber 18 of each of the cylinders.

The combustion chamber 18 of each cylinder is formed as the space between the cylinder head and the piston 19 in the main body of the engine 1. The intake port 16 communicates with the combustion chamber 18 on one side of the combustion chamber 18 with respect to the center axis of the cylinder and an exhaust port 22 communicates with the combustion chamber 18 on the opposite side from the intake port 16. Each of the intake ports 16 is opened and closed by an intake valve 20. The intake valves 20 are each driven by an intake cam 21 in a conventional manner. Similarly, each of the exhaust ports 22 is opened and closed by an exhaust valve 23. The exhaust valves 23 are each driven by an exhaust cam 24 in a conventional manner. A variable intake valve mechanism 25 is provided with respect to the intake cams 21 and a variable exhaust valve mechanism 26 is provided with respect to the exhaust cams 22. The variable valve mechanisms 25 and 26 are configured and arranged to vary the phase of the intake cams 21 and the exhaust cams 24 with respect to the respective cam shafts so that the operating characteristics of the intake valves 20 and the exhaust valves 23 can be varied. Any conventional variable valve mechanism can be utilized as the variable valve mechanisms 25 and 26. For example, the conventional variable valve mechanism includes, but not limited to, hydraulically operated and solenoid operated valve mechanisms. In this embodiment, the variable valve mechanisms 25 and 26 are preferably configured and arranged to vary the open and close timing (i.e., the valve timing) of the intake valves 20 and the exhaust valves 23 so that the overlap period during which both the intake valve 20 and the exhaust valve 23 of a corresponding cylinder are open (hereinafter referred to as "overlap period") can be changed. A spark plug 27 is installed in the cylinder head and arranged to face the approximate center of an upper portion of the combustion chamber 18.

As seen in FIG. 1, the engine 1 has an exhaust passage 28 with a first catalytic converter 29 installed in the exhaust passage 28 immediately downstream of the exhaust manifold and a second catalytic converter 30 is installed immediately downstream of the first catalytic converter 29. The exhaust gas that leaves the exhaust ports 22 is configured to pass through the first and second catalytic converters 29 and 30 and a muffler 31 before being discharged to the atmosphere.

The engine 1 is provided with an engine control unit ("ECU") 41 as seen in FIG. 1. The engine control unit 41 is configured to control the operation of the injectors 17, the sparkplugs 27, and the variable valve mechanisms 25 and 26. The engine control unit 41 is configured to receive various input signals from various sensors provided in the engine. More specifically, the engine control unit 41 is configured to receive a signal indicative of an intake air quantity detection from an air flow meter 50, a signal indicative of an intake air pressure or manifold pressure from a pressure sensor 52, a signal indicative of an intake air temperature from a temperature sensor 53, a signal indicative of a coolant temperature from a temperature sensor 54, a signal indicative of a unit crank angle and reference crank angle from a crank angle sensor 55 (the engine control unit 41 is configured to uses this signal to calculate an engine rotational speed NE), a signal indicative of an exhaust gas pressure from a pressure sensor 56, a signal indicative of an exhaust gas temperature from a temperature sensor 57, a signal indicative of an air-fuel ratio from an oxygen sensor 58, a signal indicative of an accelerator position from an accelerator 59, and signals indicative of cam angles from cam sensors 60 and 61 (these signals enable the actual phase difference between the cams 21 and 24 and the camshafts to be detected). Due to the large-volume surge tank 14, the intake air pressure detected by the pressure sensor 52 corresponds to a value in which any effects that pulsations might have on the intake air pressure are smoothed or flattened out. It is also acceptable to execute further smoothing by applying computer processing that averages the detected values from the pressure sensor 52. It is also acceptable to estimate a smoothed intake air pressure based on the engine operating conditions. The engine control unit 41 is configured to set control quantities for the aforementioned devices (e.g., the injectors 17, the spark plug 27 and the variable valve trains 25 and 26) based on the various input signals.

The engine control unit 41 preferably includes a microcomputer with an intake air pressure estimation program that estimates the intake air pressure as discussed below. The engine control unit 41 can also include other conventional components such as an input interface circuit, an output interface circuit, and storage devices such as a ROM (Read Only Memory) device and a RAM (Random Access Memory) device. The microcomputer of the engine control unit 41 is programmed to control the intake air pressure estimating processing. The memory circuit stores processing results and control programs that are run by the processor circuit. The engine control unit 41 is operatively coupled to the various sensors and the devices of the engine in a conventional manner. The internal RAM of the engine control unit 41 stores statuses of operational flags and various control data. The internal ROM of the engine control unit 41 stores the maps and data for various operations. The engine control unit 41 is capable of selectively controlling any of the components of the control system in accordance with the control program. It will be apparent to those skilled in the art from this disclosure that the precise structure and algorithms for the engine control unit 41 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

In this embodiment, the engine control unit 41 is configured to function as the intake air pressure estimating device, which can be consider to be the intake air pressure estimating device or the tuning frequency estimating device depending on the final parameter that is to be estimated. First, the estimation of the tuning frequency executed by the engine control unit 41 will now be described.

In this embodiment, a tuning order is calculated based on the engine rotational speed and a fundamental frequency calculated based on the speed of sound and the shape of the intake air pipe. The tuning order is then used to calculate the tuning frequency of the intake air pressure wave. The tuning frequency of the intake air pressure wave is a frequency that tunes or resonates to the engine rotational speed and means the same thing as the tuning rotational speed of the engine. In this embodiment, the tuning frequency of the intake air pressure wave is calculated as the tuning rotational speed of the engine.

Figure 2:
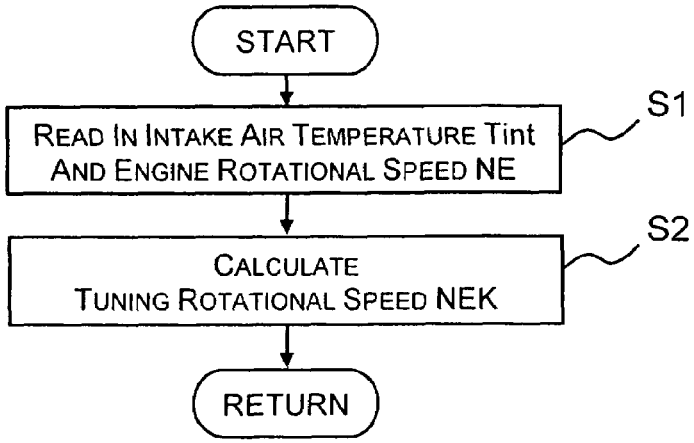
FIG. 2 is a flowchart of a tuning rotational speed calculating routine executed in the intake air pressure estimating device in accordance with the first embodiment of the present invention.

FIG. 2 is a flowchart of the routine for calculating the tuning rotational speed (tuning frequency) executed in the engine control unit 41.

Figure 6:
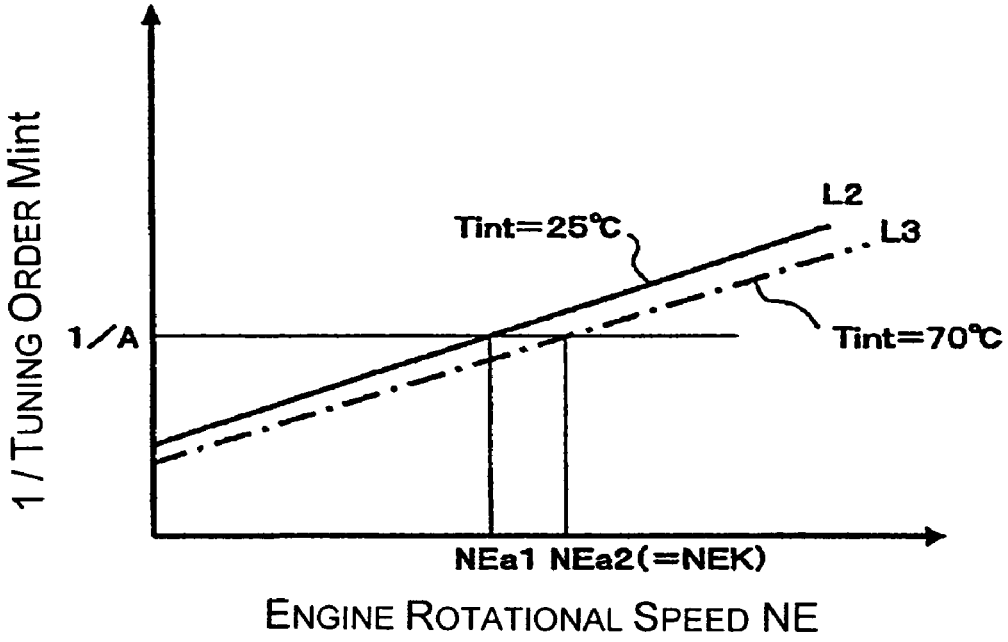
FIG. 6 is a diagram illustrating a tuning order table used in the intake air pressure estimating device in accordance with the first embodiment of the present invention.

The tuning order table shown in FIG. 6 (the straight line L2 indicated as a solid line in FIG. 6) is stored in the engine control unit 41. The engine control unit 41 is configured to use this tuning order table to calculate the tuning rotational speed corresponding to the actual operating conditions as indicated in steps S1 and S2 of FIG. 2.

The process of creating the tuning order table will now be described with reference to the flowchart of FIG. 3. The tuning order table is created by using a simulation or the results of an experiment to correct a theoretical equation that calculates the tuning order corresponding to a reference intake air temperature (e.g., 25° C.).

In step S11, the engine control unit 41 is configured to set an equivalent pipe length Le corresponding to when the intake valve is closed using the equation (1) shown below based on the actual pipe length Lint of the intake passage 11 and an open end correction amount ΔLint.

$$Le=2(Lint+\Delta Lint) \tag{1}$$

In step S12, the fundamental frequency Fint corresponding to a reference temperature of 25° C. is calculated using the equation (2) shown below based on the speed of sound Spsd and the equivalent pipe length Le. The speed of sound Spsd is calculated using the equation (3), also shown below based on the temperature Tint of the intake air, the specific heat ratio κair, and the gas constant Rair. In step S12, the temperature Tint of the intake air is set to 25° C.

$$Fint=\frac{Spsd}{(2\times Le)} \tag{2}$$

$$Spsd=\sqrt{\kappa air\times Rair\times Tint} \tag{3}$$

In step S13, the engine control unit 41 is configured to calculate the tuning order characteristic corresponding to a case in which the pressure waves existing in the air intake pipe are assumed to be standing waves. More specifically, based on the engine rotational speed NE and the fundamental frequency Fint calculated in step S12, the engine control unit 41 is configured to calculate a modeled tuning order Mint0 as a function of the engine speed NE for a case in which the equivalent length equals the modeled equivalent length Le and the intake air temperature equals the reference intake air temperature of 25° C. to find the modeled tuning order characteristic (reference tuning order characteristic) indicated with the dotted straight line L1 in FIG. 4. The straight line L1 indicates the inverse of the modeled tuning order Mint0 that is expressed with the following equation (4).

$$\frac{1}{Mint0} = \left(\frac{1}{(120 \times Fint)}\right) \times NE \tag{4}$$

In step S14, the engine control unit 41 is configured to correct the modeled tuning order characteristic determined in step S13 so as to obtain a characteristic that is appropriate for traveling waves. The corrected tuning order characteristic for traveling waves is indicated by the solid straight line L2 in FIG. 4, which is set as a fundamental tuning order. The correction performed in step S14 is preferably accomplished as follows. A simulation or experiment is conducted to find an intake/exhaust pressure ratio Ppr, which is a ratio of the intake pressure to the exhaust pressure obtained with the actual intake air pipe shape as a function of the engine speed NE for a case in which the intake air temperature equals the reference intake air temperature (25° C. in this embodiment). The simulation or experiment is conducted using the manifold pressure as a parameter such that data corresponding to a plurality of manifold pressures is obtained. FIG. 5 shows an example of the intake/exhaust pressure ratio Ppr waveform when a manifold pressure Pmani is 1. The engine control unit 41 is configured to acquire the point where an actual tuning order Mint equals A from the obtained waveform shown in FIG. 5, and then acquire the engine rotational speed NEa1 corresponding to the point where the tuning order Mint equals A. Next, the engine control unit 41 is configured to find the ratio of the engine rotational speed NEa1 and the engine rotational speed NEa0 corresponding to the point along the line L1 of FIG. 4 where the tuning order Mint equals A and set the correction coefficient K using the equation (5) shown below.

$$K = \frac{NEa0}{NEa1} \tag{5}$$

Figure 4:
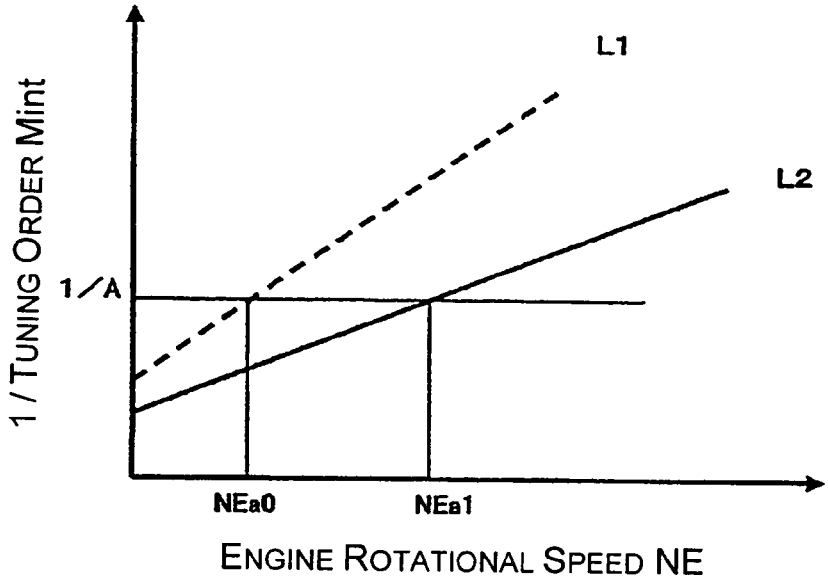
FIG. 4 is a diagram for explaining how a fundamental tuning order characteristic is created in accordance with the first embodiment of the present invention.
Figure 5:
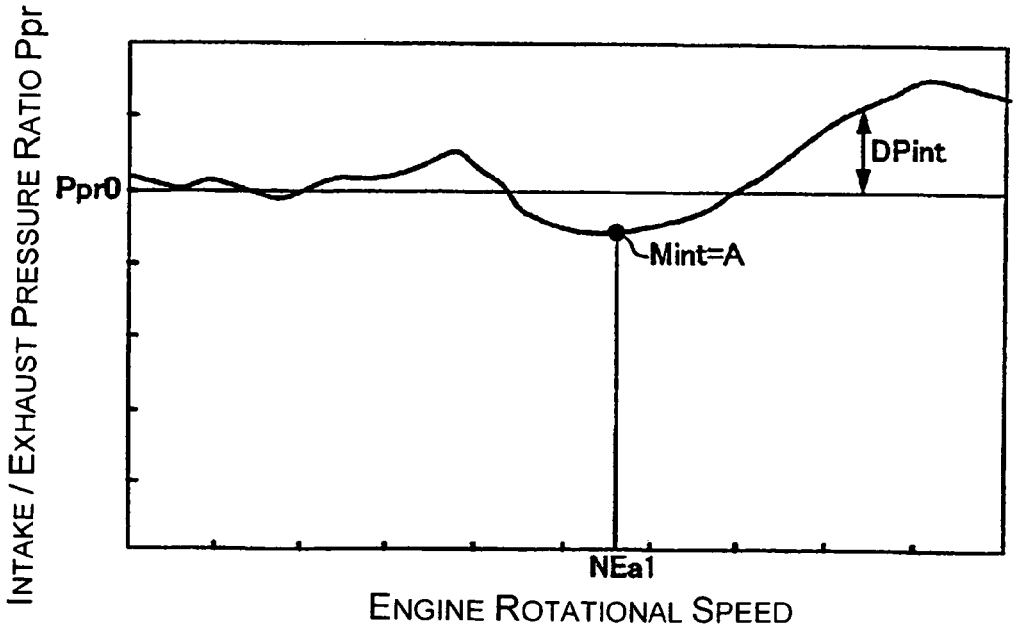
FIG. 5 is a plot of the actual intake/exhaust pressure ratio versus the engine rotational speed in accordance with the first embodiment of the present invention.

Then, using the correction coefficient K in the equation (6) shown below, the engine control unit 41 is configured to correct the slope of the straight line L1 in FIG. 4 such that the modeled tuning order Mint0 obtained in step S13 is matched to the actual tuning order Mint, i.e., such that the tuning order characteristic indicated by the straight line L2 of FIG. 4 is obtained. The tuning order characteristic indicated by the straight line L2 is used as the fundamental tuning order.

$$\frac{1}{Mint} = \left(\frac{1}{(120 \times Fint)}\right) \times K \times NE \tag{6}$$

The engine control unit 41 is configured to store the fundamental tuning order characteristic (the straight line L2 in FIG. 4) obtained as a result of the traveling wave correction executed in step S14 as a tuning order table. The fundamental tuning order characteristic can also be stored as a function instead of a table.

When the engine control unit 41 calculates the actual tuning rotational speed according to the flowchart shown in FIG. 2, in step S1, the engine control unit 41 is configured to read in the intake air temperature Tint and the engine rotational speed NE. In step S2, the engine control unit 41 is configured to calculate the tuning rotational speed NEK corresponding to the detected intake air temperature Tint. More specifically, the tuning order A corresponding to the detected engine rotational speed NE (NEa1 in FIG. 6) is found using the fundamental tuning order characteristic based on the reference intake air temperature, i.e., the straight line L2 shown in the tuning order table of FIG. 6. The equations (2) and (3) mentioned above are then used to calculate the fundamental frequency Fint corresponding to the detected intake air temperature Tint (e.g., 70° C.). The tuning order A found from the table and the calculated fundamental frequency Fint are then used in the equation (6) above to calculate the engine rotational speed NEa2, which is used as the actual tuning rotational speed NEK.

Thus, in this embodiment, the tuning order A is calculated based on the fundamental frequency Fint of the intake air and the engine rotational speed NE and the tuning order A is used to calculate the tuning rotational speed NEK of the engine (i.e., tuning frequency of the intake gas pressure wave). As a result, an intake air pressure wave tuning frequency that takes into account both the engine rotational speed NE and the intake air temperature Tint can be calculated, and thus, the accuracy with which the tuning frequency of the intake air pressure wave is estimated is improved. Furthermore, since only one table indicating a fundamental tuning order characteristic (the straight line L2 in FIGS. 4 and 6) need prepared, the memory capacity of the engine control unit 41 can be used more frugally. However, it is also acceptable to use the equation (6) above to obtain the tuning order characteristic corresponding to an intake air temperature of 70° C., i.e., the characteristic indicated by the straight line L3 of FIG. 6, and calculate the tuning rotational speed NEK by finding the engine rotational speed NEa2 where the value of 1/Mint equals 1/A according to that tuning order characteristic.

Figure 3:
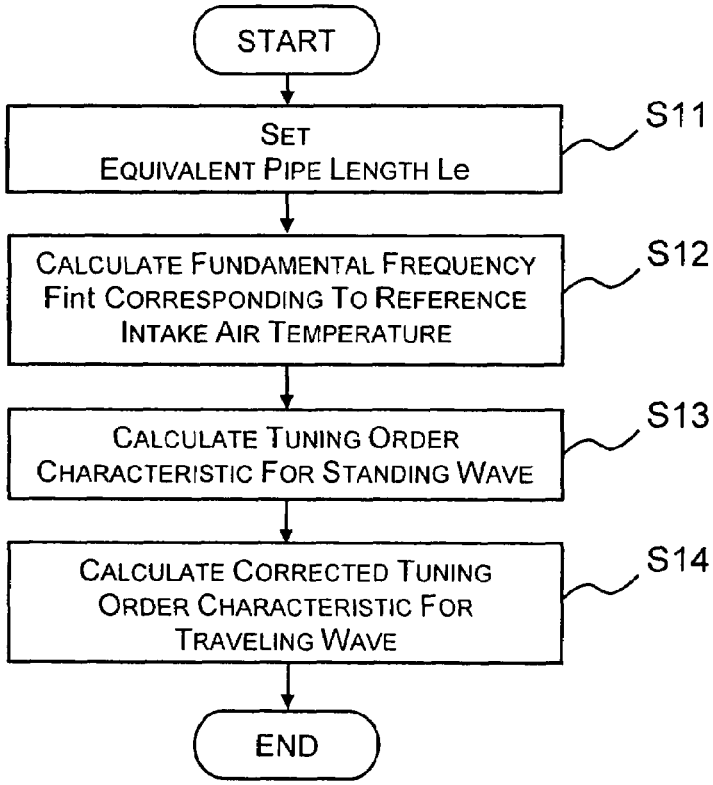
FIG. 3 is a flowchart for explaining the process of creating a tuning order table executed in the intake air pressure estimating device in accordance with the first embodiment of the present invention.

Furthermore, by using the tuning order characteristic (fundamental tuning order characteristic shown in the straight line L2 in FIGS. 4 and 6) obtained from the correction executed in step S14 in FIG. 3, both the attenuation of the intake air pressure wave that takes place during the period from commencement of one intake until the commencement of the next intake and the effect of the intake strokes of the other cylinders can also be taken into account, thus enabling the tuning frequency of the intake air pressure wave to be calculated even more accurately.

Figure 7:
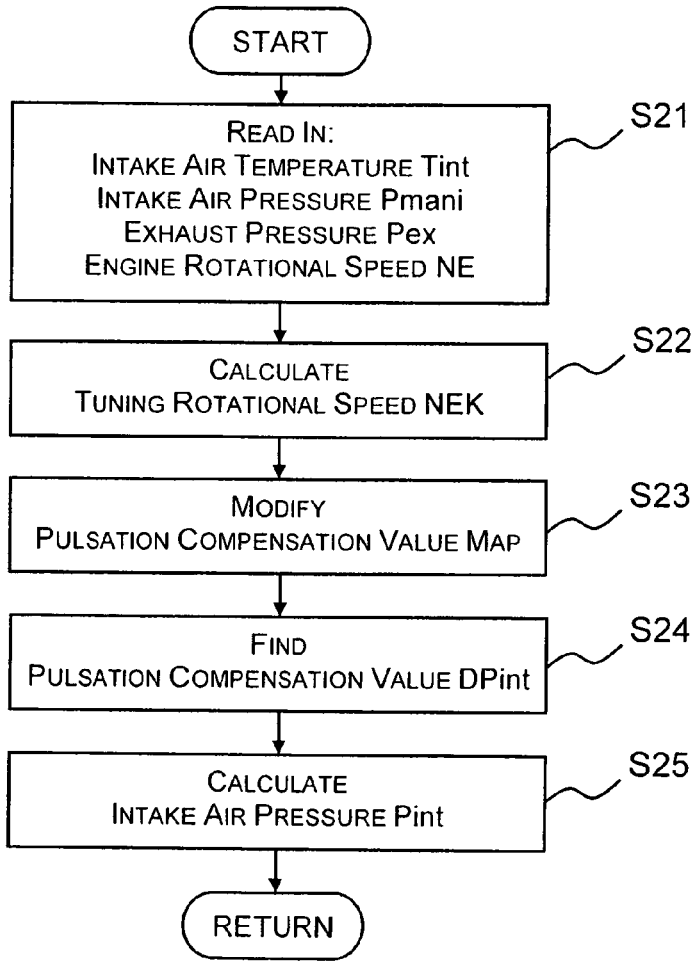
FIG. 7 is a flowchart of an intake air pressure detection routine executed in the intake air pressure estimating device in accordance with the first embodiment of the present invention.

Referring now to FIG. 7, the way in which the tuning frequency estimating device of this embodiment is used to estimate the intake air pressure in the vicinity of the intake valve 20 by taking into account the effects of pressure pulsation will now be described.

FIG. 7 shows a flowchart of the intake air pressure detection or estimation routine of this embodiment. The routine described in FIG. 7 is preferably executed in the engine control unit 41 once per prescribed period of time.

Figure 8:
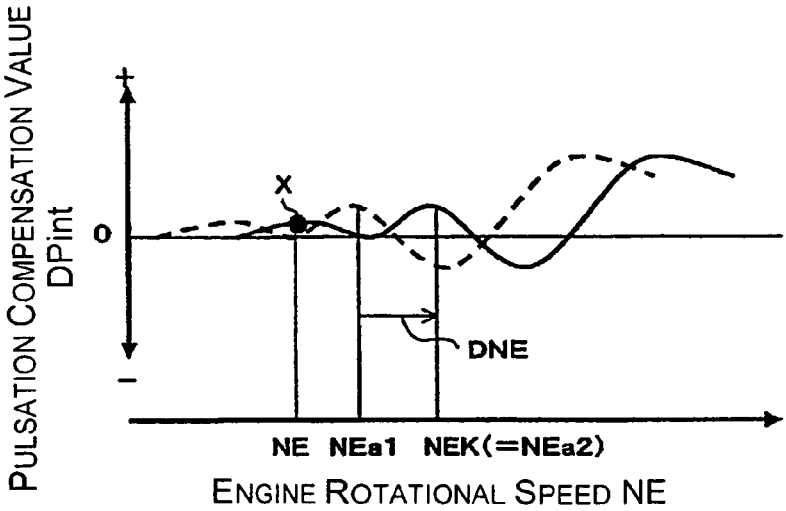
FIG. 8 is a diagram for explaining how a pulsation compensation value is found in accordance with the first embodiment of the present invention.

In addition to the tuning order table shown in FIG. 6, the engine control unit 41 is configured to store the pulsation compensation value table plotting a pulsation compensation value DPint with respect to the engine rotational speed NE as shown in FIG. 8. The engine control unit 41 is configured to calculate the amount of change DNE of the tuning rotational speed NEK corresponding to the actual operating conditions with respect to the tuning rotational speed corresponding to the reference intake air temperature, and shift the characteristic curve (dashed-line curve of FIG. 8) of the pulsation compensation value DPint by the amount of change DNE relative to the engine rotational speed NE axis of the pulsation compensation value table shown in FIG. 8. Then, the engine control unit 41 is configured to refer to the shifted characteristic curve (solid-line curve of FIG. 8) and search for the actual pulsation compensation value DPint. The engine control unit 41 is then configured to add the actual pulsation compensation value DPint found from the shifted table to the detected intake air pressure Pmani to calculate the intake air pressure PDint in the vicinity of the intake valve 20 with the contribution of pressure pulsation taken into account.

The pulsation compensation value table shown in FIG. 8 will now be described in more detail.

The pulsation compensation value table is established as follows. A simulation or experiment is conducted to find the intake/exhaust pressure ratio Ppr with the contribution of pressure pulsation taken into account as a function of the engine speed NE under conditions in which the actual air intake pipe shape is used and the intake air temperature equals the reference intake air temperature (e.g., 25° C.). The simulation or experiment is conducted using the throttle opening degree as a parameter such that data corresponding to a plurality of throttle opening degrees is obtained. Then, the differences between the intake/exhaust pressure ratios Ppr found with the simulation or experiment and a smoothed intake/exhaust pressure ratios Ppr0 are found, as shown in FIG. 5. These difference values are converted to pressure values and arranged in a table as pulsation compensation values DPint. The resulting pulsation compensation value table shown in FIG. 8 is stored in the engine control unit 41. FIG. 5 only shows the results for the case in which the throttle opening degree is fully open.

Referring back to FIG. 7, in step 21, the engine control unit 41 is configured to read in the intake air temperature Tint, the intake air pressure Pmani, the exhaust pressure Pex, and the engine rotational speed NE from the respective sensors.

In step 22, the engine control unit 41 is configured to calculate the tuning rotational speed NEK corresponding to the detected intake air temperature Tint. For example, when the tuning order Mint equals A and the detected intake air temperature Tint is 70° C., the engine rotational speed NEa2 is calculated as the tuning rotational speed NEK by using the above equation (6).

In step 23, the engine control unit 41 is configured to calculate the difference DNE between the tuning rotational speed NEK (=NEa2) calculated in step 22 and the engine rotational speed NEa1 at which the tuning order Mint equals A under conditions of the reference intake air temperature. Then the engine control unit 41 is configured to modify the pulsation compensation value table by shifting the characteristic curve of the pulsation compensation value DPint corresponding to the ratio of the detected intake air pressure Pmani and exhaust pressure Pex (indicated with broken line in FIG. 8) by the difference DNE relative to the engine rotational speed axis. The modified characteristic curve of the pulsation compensation value DPint is indicated with a solid line in FIG. 8.

In step 24, the engine control unit 41 is configured to use the modified characteristic curve of the pulsation compensation value DPint to find the pulsation compensation value DPint (point X in FIG. 8) corresponding to the detected engine rotational speed NE.

In step 25, the engine control unit 41 is configured to add the pulsation compensation value DPint to the detected intake air pressure Pmani as in the equation (7) below to calculate the intake air pressure Pint in the vicinity of the intake valve 20 with the contribution of pressure pulsation taken into account.

$$Pint=Pmani+DPint \tag{7}$$

Accordingly, with the present invention, the intake air pressure tuning frequency is calculated using the engine rotational speed NE and a fundamental frequency Fint that changes in accordance with the change in the intake air temperature Tint. As a result, the tuning frequency of the intake air pressure, which changes depending on both the intake air temperature Tint and the engine rotational speed NE, can be calculated with better accuracy. Therefore, the intake air pressure Pint can be estimated with high accuracy.

In summary, the intake parameter estimating device of the present invention uses the tuning order corresponding to a reference intake air temperature that is calculated using theoretical equations based on the fundamental frequency of the intake air pressure wave and the detected engine rotational speed. The actual intake air pressure wave as a function of the engine rotational speed is calculated by simulation or the like under the assumption that the intake air temperature equals the reference intake air temperature, and a tuning order is acquired from the resulting data. The theoretical tuning order is then corrected to match the tuning order acquired from the simulation data. Using the modified tuning order characteristic corresponding to the reference intake air temperature, the tuning rotational speed of the engine corresponding to the current detected intake air temperature Tint is calculated. The tuning rotational speed is used as the tuning frequency of the intake air pressure wave.

SECOND EMBODIMENT

Referring now to FIGS. 9 to 12, an intake air pressure estimating device in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The intake air pressure estimating device in the second embodiment is basically identical to the intake air pressure estimating device as explained above except for the process for obtaining the pulsation compensation value DPint in order to estimate the pulsating intake air pressure. More specifically, in the second embodiment, the engine control unit 41 is configured to calculate the pulsation compensation value DPint equivalent to the amount of change in the intake air pressure due to pressure pulsation using a pulsation amplitude parameter and a pulsation phase parameter and estimate the pulsating intake air pressure by correcting the smoothed intake air pressure detected by the pressure sensor 52 using the pulsation compensation value. In determining the pulsation compensation value DPint, the intake/exhaust pressure ratio is used as an amplitude parameter and the engine rotational speed is used as a phase parameter. Thus, in the second embodiment of the present invention, the intake air pressure in the vicinity of the intake valve can be estimated with better accuracy even during the overlap period for calculating the quantity of residual gas (internal EGR quantity).

First, an overview of the pulsation phase parameter will be presented. Similar to the first embodiment explained above, a tuning order is calculated using the engine rotational speed and the fundamental frequency that has been calculated based on the shape of the air intake pipe and the speed of sound. This tuning order is then used to calculate the tuning frequency of the intake air pressure pulsation (pressure waves). As in the first embodiment, the tuning frequency of the intake air pressure pulsation (pressure waves) is the engine rotational speed that tunes to the intake air pressure pulsation and is also called the "tuning rotational speed." The intake air pressure pulses are synchronized with the opening and closing of the intake valves, i.e., are traveling waves corresponding to the engine rotational speed. Therefore, the characteristic curve of the tuning order versus the engine rotational speed, which is obtained assuming that the pressure wave is a standing wave, is corrected in accordance with the characteristics of traveling waves. Additionally, since the speed of sound varies depending on the temperature of the intake air, the characteristic curve of the tuning order versus the engine rotational speed is further corrected in accordance with the temperature of the intake air. By using a tuning rotational speed characteristic calculated as described above, the engine rotational speed to be used as the pulsation phase parameter is obtained.

Figure 10:
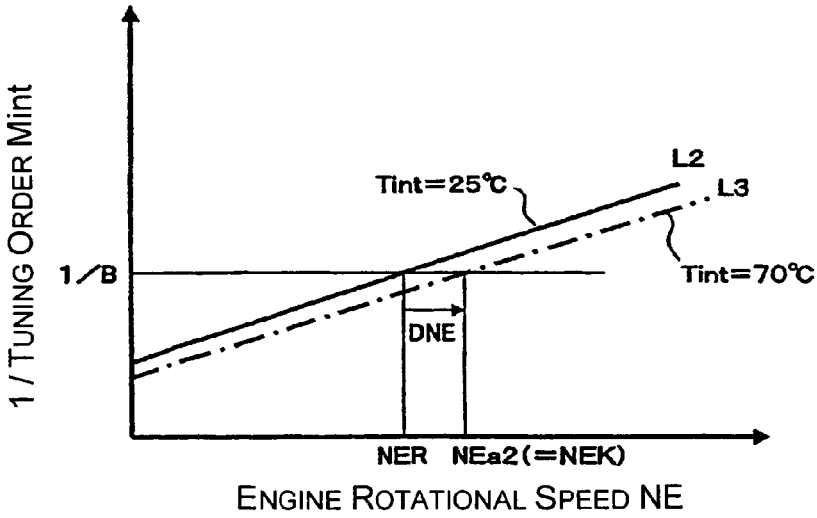
FIG. 10 is a diagram illustrating a tuning order table used in an intake air pressure estimating device in accordance with the second embodiment of the present invention.

In the second embodiment, the tuning order table as shown in the straight line L2 in FIG. 10 is stored in the engine control unit 41. The process of calculating the tuning frequency in the second embodiment is identical to the process shown steps S1 and S2 described in FIG. 2 of the first embodiment.

Moreover, the process of obtaining the tuning order table shown in FIG. 10 in the second embodiment is basically identical to the process described in the flowchart in FIG. 2 and the tuning order characteristic table in FIG. 4 in the first embodiment except for the traveling wave correction in step S14.

Similar to the first embodiment, in step S14, the engine control unit 41 is configured to correct the tuning order characteristic found in step S13 to obtain a characteristic that is appropriate for traveling waves. The corrected tuning order characteristic for traveling waves is indicated by the solid straight line L2 in FIG. 4 and is set as a fundamental tuning order. In the second embodiment, first, a simulation or experiment is conducted to find the ratio Ppr of the intake pressure to the exhaust pressure obtained with the actual intake air pipe shape as a function of the engine speed NE for a case in which the intake air temperature equals the reference intake air temperature (25° C. in this embodiment). The intake/exhaust pressure ratio Ppr is calculated as the ratio of the intake air pressure detected by the pressure sensor 52 to the exhaust pressure detected by the pressure sensor 56 and used as a parameter representing the amplitude of the intake air pressure pulsation.

Figure 9:
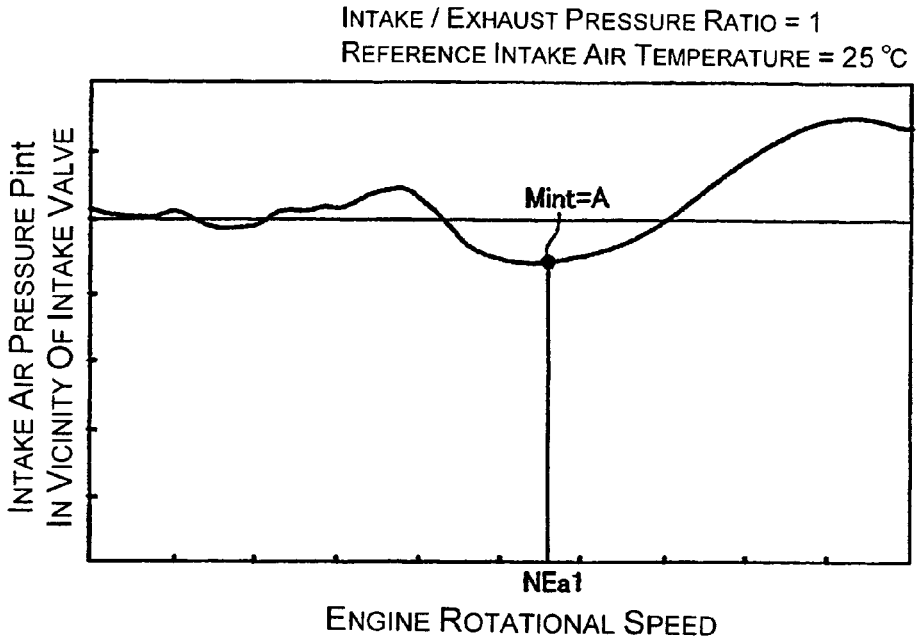
FIG. 9 is a plot of the intake air pressure in the vicinity of the intake valve versus the engine rotational speed for a case in which the throttle valve is fully opened and the reference intake air temperature are assumed in accordance with a second embodiment of the present invention.

FIG. 9 shows the waveform of the intake air pressure in the vicinity of the intake valve when the intake/exhaust pressure ratio Ppr is 1, which corresponds to the case where the throttle valve 13 is in fully open state in which the pulsation of the intake air pressure is great. The engine control unit 41 is configured to acquire the point along the actual characteristic where the tuning order Mint equals a prescribed value A and acquire the engine rotational speed NEa1 corresponding to the point where the tuning order Mint equals A. The tuning order Mint has integer values indicated as "n" at points corresponding to valleys of the waveform and values of n+½ at points corresponding to peaks of the waveform. The portion where the tuning order Mint equals the prescribed value A corresponds to a peak or a valley that is determined by calculating n based on the engine rotational speed at that time.

Next, similar to the first embodiment the engine control unit 41 is configured to find the ratio of the engine rotational speed NEa1 and the engine rotational speed NEa0 corresponding to the point along the line L1 of FIG. 4 where the tuning order Mint equals A and sets the correction coefficient K using the equation (5) explained above. Using the correction coefficient K in the equation (6) explained above, the engine control unit 41 is configured to correct the slope of the straight line L1 such that the modeled tuning order Mint0 obtained in step S13 of FIG. 3 is matched to the actual tuning order Mint, i.e., such that the tuning order characteristic indicated by the straight line L2 of FIG. 4 is obtained. The tuning order characteristic indicated by the straight line L2 is used as the fundamental tuning order.

In the second embodiment too, the engine control unit 41 is configured to store the fundamental tuning order characteristic (line L2) obtained as a result of the traveling wave correction executed in step S14 as a tuning order table. The fundamental tuning order characteristic can also be stored as a function instead of a table.

When the engine control unit 41 calculates the actual tuning rotational speed according to FIG. 2, in step S1 the engine control unit 41 is configured to read in the intake air temperature Tint and the engine rotational speed NE. In step S2, the engine control unit 41 is configured to calculate the tuning rotational speed NEK corresponding to the detected intake air temperature Tint. More specifically, the tuning order B corresponding to the detected engine rotational speed NER is found using the fundamental tuning order characteristic based on the reference intake air temperature, i.e., the straight line L2 shown in the tuning order table of FIG. 10. The above explained equations (2) and (3) are then used to calculate the fundamental frequency Fint corresponding to the detected intake air temperature Tint (e.g., 70° C.). The tuning order B and the calculated fundamental frequency Fint are then used in the above explained equation (6) to calculate the engine rotational speed NEa2, which is used as the actual tuning rotational speed NEK.

Thus, a tuning order is calculated based on the fundamental frequency of the intake gas and the engine rotational speed and the tuning order is used to calculate the tuning rotational speed of the engine. As a result, a tuning rotational speed characteristic that takes into account the engine rotational speed in addition to the intake air temperature can be calculated.

Furthermore, by using the tuning order characteristic (fundamental tuning order characteristic) obtained by correcting for the fact that the pressure pulsations are traveling waves in step S14, the attenuation that takes place during the period from commencement of one intake until the commencement of the next intake and the effect of the intake strokes of the other cylinders can also be taken into account, thus enabling the tuning rotational speed characteristic to be calculated even more accurately. Since the tuning rotational speed characteristic correlates with the phase of the intake air pressure pulsations, the use of this characteristic improves the accuracy with which the amount of change in the intake air pressure due to pressure pulsation is estimated as discussed in more detail below.

By using a tuning rotational speed characteristic calculated as described above, the intake air pressure in the vicinity of the intake valve can be calculated to take into account the effect of pressure pulsations using the intake/exhaust pressure ratio as a parameter representing the amplitude of the intake air pressure pulses and the engine rotational speed as a parameter representing the phase of the pressure pulses. The ratio of the pressure inside the cylinder immediately before the intake valve 20 opens to the pressure inside the air intake pipe serves as the exciting force that causes intake air pulsation to occur. Thus, the amplitude of the pulses correlates to the excitation force. Since the exhaust valve 23 is open immediately before the intake valve 20 opens, the exhaust pressure can be used as the pressure inside the cylinder immediately before the intake valve opens and, thus, the intake/exhaust pressure ratio Ppr can be used as a parameter representing the amplitude of the intake air pressure pulses. It is also acceptable to estimate the pressure inside the cylinder (exhaust pressure) immediately before the intake valve 20 opens using the engine operating conditions.

When the intake/exhaust pressure ratio Ppr is used as the amplitude parameter, it will not be a problem if the internal EGR ratio is changed by changing the valve timing or the like because the exhaust pressure used as the pressure inside the cylinder immediately before the intake valve 20 opens will be a detected value that includes the change resulting from the change in the internal EGR ratio. In other words, unlike the technology presented in the aforementioned Japanese Laid-Open Patent Publication No. 10-153465 as mentioned above in which the change in amplitude resulting from a change in the internal EGR ratio cannot be ascertained because the throttle opening degree is used as the amplitude parameter, this embodiment can ascertain the amplitude of the intake air pressure pulsation with high accuracy and does not need an additional correction to adapt to a change in the internal EGR.

Figure 11:
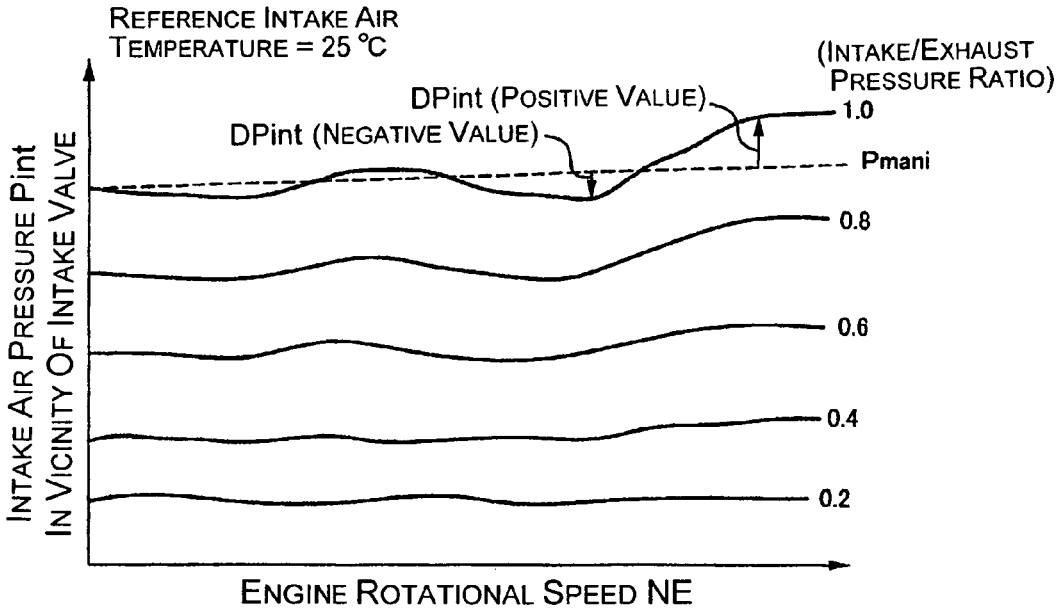
FIG. 11 is diagrammatic view illustrating plots of the intake air pressure in the vicinity of the intake valve versus the engine rotational speed for a plurality of different intake/exhaust pressure ratios (the intake/exhaust pressure ratio serving as an amplitude parameter) for a case in which the reference intake air temperature is assumed in accordance with the second embodiment of the present invention.
Figure 12:
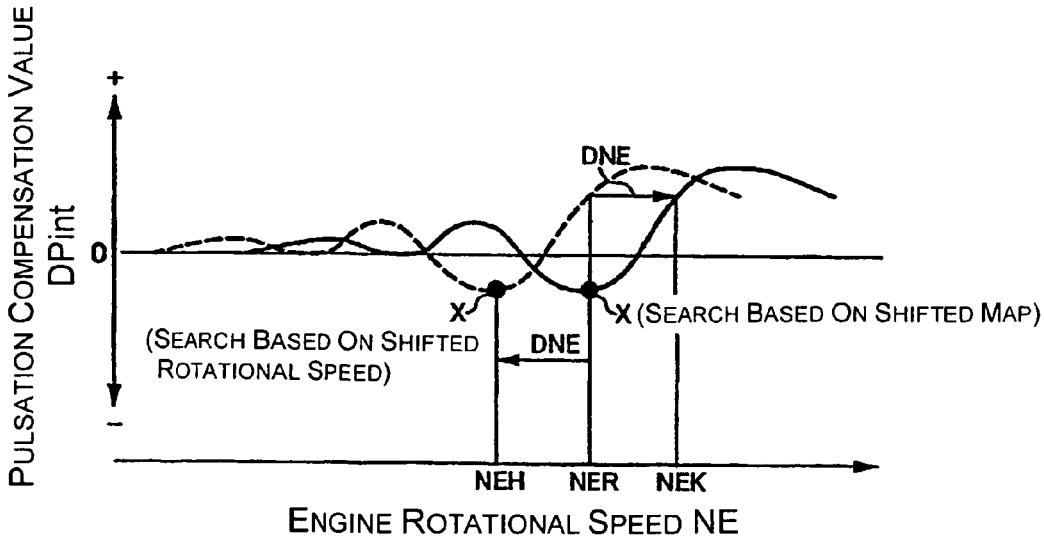
FIG. 12 is a diagram for explaining how the pulsation compensation value is found in accordance with the second embodiment of the present invention.

In addition to the tuning order table of FIG. 10, the engine control unit 41 also stores a pulsation compensation value map as shown in FIG. 12. The pulsation compensation value map comprises a map of pulsation compensation values DPint that are obtained by finding the difference (positive or negative value) between the pulsating intake air pressure and the smoothed intake air pressure. In the second embodiment of the present invention, the pulsating intake air pressure values being obtained from characteristic plots (obtained by simulation) of the pulsating intake air pressure versus the engine rotational speed for a plurality of different intake/exhaust pressure ratios Ppr at the reference intake air temperature (e.g., 25° C.) as shown in FIG. 11.

The intake air pressure estimation routine in accordance with the second embodiment of the present invention is basically identical to the intake air pressure estimation routine of the first embodiment as described in the flowchart of FIG. 7. Similar to the first embodiment, this routine is executed once per prescribed period of time.

In step 21, the engine control unit 41 is configured to read in the intake air temperature Tint, the intake air pressure Pmani, the exhaust pressure Pex, and the engine rotational speed NE from the respective sensors.

In step 22, the engine control unit 41 is configured to calculate the tuning rotational speed NEK corresponding to the detected intake air temperature Tint. For example, when the tuning order Mint equals B and the detected intake air temperature Tint is 70° C., the engine rotational speed NEa2 is calculated as the tuning rotational speed NEK.

In step 23, the engine control unit 41 is configured to calculate the difference DNE between the detected current engine speed NER and the tuning rotational speed NEK calculated in step 22 and modify the pulsation compensation value map by shifting the characteristic curve of the pulsation compensation value DPint corresponding to the ratio of the detected intake air pressure Pmani and exhaust pressure Pex (indicated with broken line in FIG. 12) by the difference DNE relative to the engine rotational speed axis. The modified characteristic curve of the pulsation compensation value DPint is indicated with a solid line in FIG. 12.

In step 24, the engine control unit 41 is configured to use the modified characteristic curve of the pulsation compensation value DPint to find the pulsation compensation value DPint (point X in FIG. 12) corresponding to the detected engine rotational speed NE. Although in the explanation presented here the map is shifted in order to make it easy to understand the concept of the modification, it would actually require complex computer processing to shift the entire set of characteristic data of the pulsation compensation value map. Instead, what is actually done is to leave the pulsation compensation value map as is and modify the detected value NE of the engine rotational speed by shifting it by the difference DNE in the opposite direction as the map was shifted in the previous explanation (i.e., if the difference DNE is positive it is subtracted from the engine speed NE, and if the difference DNE is negative the magnitude thereof if added to the engine speed NE). The resulting modified engine speed NEH is then used with the original map (indicated with a dotted line) to find the same value X. This approach simplifies the computer processing.

In step 25, the engine control unit 41 is configured to add the pulsation compensation value DPint to the detected intake air pressure Pmani as in the above equation (7) to calculate the intake air pressure Pint in the vicinity of the intake valve with the contribution of pressure pulsation taken into account.

Thus, in the second embodiment of the present invention, since the intake air pressure is estimated using the intake/exhaust pressure ratio Ppr as an amplitude parameter and the engine rotational speed as a phase parameter, the intake air pressure in the vicinity of the intake valve can be estimated with better accuracy.

The pressure inside the cylinder immediately before the intake valve opens includes the effect of the internal EGR ratio, and the ratio of the pressure inside the cylinder immediately before the intake valve 20 opens to the pressure inside the air intake pipe acts as the exciting force that causes intake air pulsation to occur. Therefore, with the second embodiment of the present invention, the pulsating state is determined based on the pressure inside the cylinder immediately before the intake valve 20 opens and the pressure inside the air intake pipe, and the smoothed detected value of the intake air pressure value is corrected in accordance with the pulsating state. In this way, the intake air pressure in the vicinity of the intake valve can be estimated with high accuracy without being affected by changes in the internal EGR ratio.

Thus, in summary, the engine rotational speed that tunes to a fundamental intake air pulsation frequency is determined based on the shape of the intake air pipe and a reference intake air temperature that is corrected (modified) by a correction of a tuning order based on the engine rotational speed, a correction based on the fact that the intake air pulsation is a traveling wave, and a correction based on the intake air temperature. Meanwhile, the relationship of the intake air pressure in the vicinity of the intake valve with respect to the engine rotational speed is found for different intake/exhaust pressure ratios, the intake/exhaust pressure ratios serving as parameters representing the amplitude of the intake air pulsation. The relationships are used to create a map for finding a pulsation compensation value. The map is searched based on the intake/exhaust pressure ratio and the engine rotational speed to find the pulsation compensation value and the pulsating intake air pressure in the vicinity of the intake valve is found by adding the pulsation compensation value to a detected value of the intake air pressure.

As used herein to describe the above embodiments, the term "detect" as used herein to describe an operation or function carried out by a component, a section, a device or the like includes a component, a section, a device or the like that does not require physical detection, but rather includes determining, estimating or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An intake air parameter estimating device for an internal combustion engine comprising:

a fundamental frequency calculating section configured to calculate a fundamental frequency of a pressure wave inside an air intake pipe based on a shape of the air intake pipe and speed of sound;

an engine rotational speed detecting section configured to detect an engine rotational speed; and a tuning frequency calculating section configured to calculate a tuning frequency of the pressure wave inside the air intake pipe based on the fundamental frequency and the engine rotational speed.

2. The intake air parameter estimating device as recited in claim 1, wherein the fundamental frequency calculating section is configured to calculate a reference fundamental frequency based on a reference temperature and an actual fundamental frequency based on an actual intake air temperature, and the tuning frequency calculating section is configured to calculate a fundamental tuning order based on the engine rotational speed and the reference fundamental frequency, and to calculate the tuning frequency using the fundamental tuning order and the actual fundamental frequency.

3. The intake air parameter estimating device as recited in claim 2, wherein the tuning frequency calculating section is further configured to determine a reference tuning order characteristic based on an assumption that the reference fundamental frequency is a standing wave, and to correct the reference tuning order characteristic to match a tuning order characteristic of a traveling wave under the reference intake air temperature to obtain the fundamental tuning order.

4. The intake air parameter estimating device as recited claim 3, wherein the tuning frequency calculating section is further configured to calculate the reference tuning order characteristic based on an equivalent pipe length of the air intake pipe obtained by modeling, and to correct the reference tuning order characteristic to match a tuning order characteristic of the traveling wave obtained with an actual shape of the air intake pipe to obtain the fundamental tuning order.

5. The intake air parameter estimating device as recited in claim 4, wherein the tuning frequency calculating section is further configured to determine a modeled tuning order based on a simulation of changes in the pressure wave inside the air intake pipe with respect to the engine rotational speed with the actual shape of the air intake pipe and at the reference intake air temperature, to calculate a correction coefficient based on the modeled tuning order and a reference tuning order obtained from the reference tuning order characteristic, and to calculate the fundamental tuning order corresponding to the engine rotational speed by multiplying the reference tuning order by the correction coefficient.

6. The intake air parameter estimating device as recited in claim 1, further comprising an intake air pressure calculating section configured to calculate an intake air pressure based on the tuning frequency of the pressure wave.

7. The intake air parameter estimating device as recited in claim 6, wherein the intake air pressure calculating section includes an intake air pressure detecting section configured to detect an intake air pressure inside the air intake pipe, and an intake air pressure correcting section configured to correct the detected intake air pressure using a pulsation compensation value obtained by calculating a reference pulsation compensation value base on the intake air pressure and the engine rotational speed and modifying the reference pulsation compensation value by a difference between the tuning frequency corresponding to actual operating conditions and a reference tuning frequency calculated based on a reference intake air temperature.

8. The intake air parameter estimating device as recited in claim 6, wherein the intake air pressure calculating section is configured to detect a cylinder pressure immediately before an intake valve opens and an intake air pressure inside the air intake pipe, and to calculate the intake air pressure in the vicinity of the intake valve based on the cylinder pressure and the intake air pressure inside the air intake pipe.

9. The intake air parameter estimating device as recited in claim 6, wherein the intake air pressure calculating section includes a pressure detecting section configured to detect or estimate a cylinder pressure immediately before an intake valve opens and an intake air pressure inside the air intake pipe, a pulsation compensation value calculating section configured to calculate a pulsation compensation value using an intake air pressure pulsation amplitude parameter calculated based on the cylinder pressure and the intake air pressure, and an intake air pressure correcting section configured to correct the intake air pressure based on the pulsation compensation value to obtain the intake air pressure in the vicinity of the intake valve.

10. The intake air parameter estimating device as recited in claim 9, wherein the pulsation compensation value calculating section is configured to use a ratio of the intake air pressure inside the air intake pipe to the cylinder pressure immediately before the intake valve opens as the intake air pressure pulsation amplitude parameter.

11. The intake air parameter estimating device as recited in claim 9, wherein the pulsation compensation value calculating section is further configured to calculate the pulsation compensation value by using an intake air pressure pulsation phase parameter as well as the intake air pressure pulsation amplitude parameter with the engine rotational speed being used as the intake air pressure pulsation phase parameter.

12. The intake air parameter estimating device as recited in claim 11, wherein the pulsation compensation value calculating section is configured to calculate the pulsation compensation value by searching a preset pulsation compensation value map.

13. The intake air parameter estimating device as recited in claim 12, wherein the pulsation compensation value calculating section is configured to adjust the pulsation compensation value map based on the tuning frequency of the pressure wave calculated in the tuning frequency calculating section.

14. The intake air parameter estimating device as recited in claim 13, wherein the pulsation compensation value calculating section is configured to shift the pulsation compensation value map in accordance with a difference between the tuning frequency at a reference temperature and the tuning frequency at an actual temperature.

15. The intake air parameter estimating device as recited in claim 14, wherein the tuning frequency calculating section is configured to calculate the tuning frequency at the reference temperature by calculating a reference tuning order of a standing wave with an equivalent pipe length at the reference temperature and correcting the reference tuning order to match a tuning order of a traveling wave with an actual shape of the air intake pipe at the reference temperature.

16. The intake air parameter estimating device as recited in claim 9, wherein, the pressure detecting section is configured to use an exhaust gas pressure inside an exhaust pipe as the cylinder pressure immediately before the intake valve opens during an overlap period when both the intake valve and an exhaust valve are open.

17. The intake air parameter estimating device as recited in claim 6, wherein the intake air pressure calculating section is configured to detect a cylinder pressure immediately before an intake valve opens and an intake air pressure inside the air intake pipe, and to calculate the intake air pressure in the vicinity of the intake valve based at least on the cylinder pressure, intake air pressure inside the air intake pipe and the engine rotational speed.

18. The intake air parameter estimating device as recited in claim 17, wherein the intake air pressure calculating section is further configured to calculate a pulsation compensation value based on the intake air pressure inside the air intake pipe, the cylinder pressure, and the engine rotational speed, and to calculate the intake air pressure in the vicinity of the intake valve based on the intake air pressure inside the air intake pipe and the pulsation compensation value.

19. A tuning frequency estimating device for an internal combustion engine comprising:

fundamental frequency calculating means for calculating a fundamental frequency of a pressure wave inside an air intake pipe based on a shape of the air intake pipe and speed of sound;

engine rotational speed detecting means for detecting an engine rotational speed; and tuning frequency calculating means for calculating a tuning frequency of the pressure wave inside the air intake pipe based on the fundamental frequency and the engine rotational speed.

20. A method of estimating a tuning frequency of an internal combustion engine comprising:

calculating a fundamental frequency of a pressure wave inside an air intake pipe based on a shape of the air intake pipe and speed of sound;

detecting an engine rotational speed; and calculating a tuning frequency of the pressure wave inside the air intake pipe based on the fundamental frequency and the engine rotational speed.

* * * * *